US010588386B2

(12) United States Patent
Lauper et al.

(10) Patent No.: US 10,588,386 B2
(45) Date of Patent: Mar. 17, 2020

(54) DECORATIVE PIECE WITH INVISIBLE SETTING

(71) Applicant: Omega S.A., Bienne (CH)

(72) Inventors: Stephane Lauper, Cortaillod (CH); Gregory Kissling, Macolin (CH); Yves Winkler, Schmitten (CH); Alban Dubach, Bienne (CH); Stewes Bourban, Chabrey (CH); Lionel Blaser, Corcelles (CH)

(73) Assignee: Omega S.A., Bienne (CH)

( * ) Notice: Subject to any disclaimer, the term of this patent is extended or adjusted under 35 U.S.C. 154(b) by 479 days.

(21) Appl. No.: 14/132,129

(22) Filed: Dec. 18, 2013

(65) Prior Publication Data

US 2014/0174125 A1 Jun. 26, 2014

(30) Foreign Application Priority Data

Dec. 21, 2012 (EP) ..... 12199275
Apr. 26, 2013 (EP) ..... 13165602

(51) Int. Cl.
*A44C 17/02* (2006.01)
*A44C 27/00* (2006.01)
*A44C 17/04* (2006.01)

(52) U.S. Cl.
CPC ..... *A44C 27/00* (2013.01); *A44C 17/04* (2013.01); *Y10T 29/23* (2015.01)

(58) Field of Classification Search
CPC ..... A44C 17/02; A44C 25/00; A44C 17/04
USPC ..... 63/32, 28, 26
See application file for complete search history.

(56) References Cited

U.S. PATENT DOCUMENTS

| | | | | |
|---|---|---|---|---|
| 4,052,863 | A * | 10/1977 | Poll | 63/28 |
| 5,338,591 | A * | 8/1994 | Poll | 428/67 |
| 6,112,552 | A * | 9/2000 | Hoffman | 63/26 |
| 8,359,883 | B2 * | 1/2013 | Dholakiya | 63/28 |
| 2006/0037361 | A1 * | 2/2006 | Johnson et al. | 63/37 |
| 2011/0113826 | A1 * | 5/2011 | Dholakiya | 63/28 |
| 2012/0225314 | A1 * | 9/2012 | Grossenbacher et al. | 428/600 |
| 2014/0174125 | A1 * | 6/2014 | Lauper et al. | 63/28 |

FOREIGN PATENT DOCUMENTS

| | | | |
|---|---|---|---|
| EP | 2 327 323 | A1 | 6/2011 |
| WO | WO 2011064092 | A1 * | 6/2011 |

OTHER PUBLICATIONS

European Search Report dated Sep. 18, 2013, in Patent Application No. EP 13 16 5602, filed Apr. 26, 2013 (With English-language Translation).

* cited by examiner

*Primary Examiner* — Emily M Morgan
(74) *Attorney, Agent, or Firm* — Oblon, McClelland, Maier & Neustadt, L.L.P.

(57) ABSTRACT

The invention relates to a decorative piece comprising a plurality of stones and a device for fixing the stones relative to each other, the fixing device comprises a single base made of a first material which makes it possible to attach all the stones relative to each other by one of their faces, the kites of stones are mounted edge to edge relative to each other so that said single base is masked, characterised in that the first material is an at least partially amorphous alloy.
The invention likewise relates to the method for manufacturing such a piece.
The invention relates to the field of jewellery, gemstone articles or timepieces.

43 Claims, 7 Drawing Sheets

DECORATIVE PIECE WITH INVISIBLE SETTING

This application claims priority from European patent application No. 13165602.7 filed Apr. 26, 2013 and European patent application No. 12199275.4 filed Dec. 21, 2012, the entire disclosure of which is hereby incorporated by reference.

FIELD OF THE INVENTION

The invention relates to a decorative piece with an invisible setting and, more precisely, a decorative piece in particular for a jewellery or gemstone article forming a paved setting of stones which is able to decorate a surface.

BACKGROUND OF THE INVENTION

It is known to set precious, semi-precious or synthetic stones with the help of claws, beads or rails. Settings of the invisible type which are integral with the stones by their culet or by their crown likewise exist. In the current state of the art for invisible setting, there are numerous methods (by milling, casting, clipping, screwing etc.) which, according to well defined systems, have multiple disadvantages: the nature, geometries and dimensions of the stones are often limited, the heights, the depths and the angles of the undercuts are often constraining, scratches, cuts and cracks in the stones exist during operations, and even repairs when changing a stone cause cuts on the adjacent stones etc. Also the majority of these methods require manual intervention of a setter during the setting operation. Even if the latter is highly qualified, the risk of loss, scratching, cracking or cutting of the stones is permanent. Another invisible setting method by the galvanic route exists, described in the patent EP 2 327 323 A1. This method which requires deposition of a first conductive layer on the stones can, according to the nature and thickness of the deposited layer, disrupt the expected aesthetic effect and make it necessary to consider the concept of "coating" on the stones, which, for an invisible setting with precious stones, makes the final object less precious. Also, this method requires good electrochemical knowledge.

SUMMARY OF THE INVENTION

The aim of the present invention is to remedy all or part of the disadvantages cited above, proposing an industrial manufacturing method which makes it possible to obtain a homogeneous mounting of the stones, a variation in shape, improved precision, better quality fixing at less cost and a less constraining aesthetic quality at the level of the regulations for gemstones.

To this end, the invention relates to a decorative piece comprising a plurality of stones and a device for fixing the stones relative to each other. The fixing device comprises a single base made of a first material which makes it possible to attach all the stones relative to each other by one of the their faces, the kites of stones are mounted edge to edge relative to each other so that said single base is masked, characterised in that the first material is an at least partially amorphous alloy.

In another advantageous embodiment, the single base makes it possible to attach all the stones relative to each other by their culet.

In another advantageous embodiment, the single base covers the totality of the culets of said stones.

In another advantageous embodiment, the single base leaves a part of the culets of said stones uncovered.

In another advantageous embodiment, the single base makes it possible to attach all the stones relative to each other by their crown.

In another advantageous embodiment, the single base covers the totality of the crowns of said stones.

In another advantageous embodiment, the single base leaves a part of the crowns of said stones uncovered.

In another advantageous embodiment, the single base makes it possible to attach a plurality of stones so that certain stones are fixed by their culet and certain stones are fixed by their crown.

In another advantageous embodiment, the single base covers the totality of the culets of certain stones and the totality of the crowns of certain other stones.

In another advantageous embodiment, the single base leaves a part of the culets of certain stones uncovered and a part of the crowns of certain other stones uncovered.

In another advantageous embodiment, the fixing device comprises at least one undercut produced in at least one of the stones at the level of their culet so that the single base, of a shape corresponding at least partially to each culet, forms at least one hook for each of said at least one of the stones.

In another advantageous embodiment, the fixing device comprises at least one undercut produced in at least one of the stones at the level of their crown so that the single base, of a shape corresponding at least partially to each crown, forms at least one hook for each of said at least one of the stones.

In another advantageous embodiment, said at least one undercut forms two grooves in two faces of the culet.

In another advantageous embodiment, said at least one undercut forms two grooves in two faces of the crown.

In another advantageous embodiment, the first material is a totally amorphous metallic material.

In another advantageous embodiment, the first material comprises at least one element which is of the precious type, included in the list comprising gold, platinum, palladium, rhenium, ruthenium, rhodium, silver, iridium or osmium.

In another advantageous embodiment, the first material is an amorphous alloy which has a glass transition temperature which is equal to or less than 450° C.

The invention likewise relates to a timepiece, characterised in that it comprises, set-in, at least one decorative piece according to the invention.

The invention likewise relates to a jewellery or gemstone article, characterised in that it comprises, set-in, at least one decorative piece according to the invention.

The invention relates likewise to a method for manufacturing a decorative piece, characterised in that it comprises the following steps:

a) providing a plurality of stones;

b) making a first face of each stone integral against a support, the kites of the stones being mounted edge to edge relative to each other so as to form a paved setting of stones;

c) covering, with a first material, at least one part of a second face of the stones in order to form a single base, said first material being a metallic alloy which is able to become amorphous;

d) withdrawing the thus formed decorative piece by separating each of said first faces relative to the support.

In an advantageous embodiment, the method comprises, between step a) and step b), the following step:

e) engraving at least one undercut in the culets and/or the crowns of said stones so that the single base produced during step c) fills each of said at least one undercut whilst forming a fixing hook.

In another advantageous embodiment, the method comprises, between step c) and step d), the following step:

g) forming a frame around said paved setting in order to surround the deposit of step c) above said culets and/or said crowns of the stones.

In another advantageous embodiment, the first face is the table of the stone, the second face being the culet of the stone.

In another advantageous embodiment, the first face is the culet of the stone, the second face being the table of the stone.

In another advantageous embodiment, the first face is the culet of the stone or the table of the stone, the second face being the table of the stone or the culet of the stone.

The invention likewise relates to a method for manufacturing a decorative piece, characterised in that it comprises the following steps:

1) providing a support provided with a housing;

2) covering the housing at least partially with a first material, said first material being a metallic alloy which is able to become amorphous;

3) forming, in said first material, at least one hole provided with fixing means;

4) setting, in said at least one hole, at least one stone provided with at least one undercut so as to induce elastic deformation of the fixing means until elastic resilience is exerted when the fixing means are situated opposite said at least one undercut;

5) withdrawing the thus formed decorative piece by separating the first set material of said stones relative to the support.

In another advantageous embodiment, covering step c) or 2) consists of an application of the first material by hot forming.

In another advantageous embodiment, covering step c) or 2) consists of an application of the first material by casting or injection.

In another advantageous embodiment, covering step c) or 2) consists of an application of the first material by powder sintering.

In another advantageous embodiment, said first material is totally amorphous.

In another advantageous embodiment, the first material comprises at least one element which is of the precious type, included in the list comprising gold, platinum, palladium, rhenium, ruthenium, rhodium, silver, iridium or osmium.

In another advantageous embodiment, the first material is in an amorphous alloy which has a Tg equal to or less than 450° C.

In another advantageous embodiment, the method comprises in addition a final step consisting of crystallising the first material.

In another advantageous embodiment, said first material is a metallic alloy which is able to become amorphous at a cooling rate of less than 100.000° C./sec.

BRIEF DESCRIPTION OF THE DRAWINGS

Other details and advantages will emerge clearly from the description which is given hereafter, by way of indication and in no way limiting, with reference to the annexed drawings in which.

DETAILED DESCRIPTION OF PREFERRED EMBODIMENTS

Figure 1:
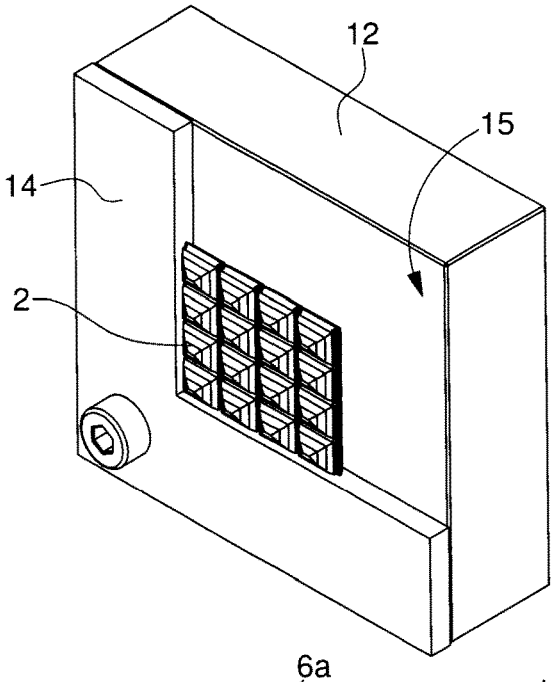
FIG. 1 is a perspective representation of a step for fixing stones according to the invention.
Figure 2:
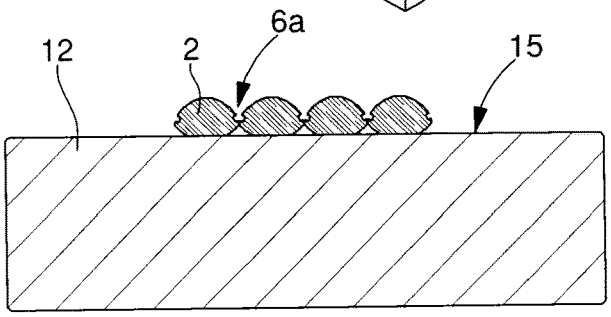
FIG. 2 is a sectional representation of the end of the fixing step according to the invention.

As illustrated in FIGS. 8 to 12, the invention relates to decorative pieces which are generally denoted 1, 3 and 5 and which are able to be set-in, in particular, on jewellery or gemstone articles and timepieces (in particular at the level of the watch face and casing). However, these decorative pieces 1, 3, 5 should not be limited to the applications above. By way of example, the decorative pieces 1, 3, 5 could likewise be set-in on other objects, such as for example spectacles.

More particularly, the invention relates to a fixing device 7, 7' of the invisible setting type which makes it possible to attach a plurality of precious, semi-precious or synthetic stones 2 by one of their faces, such as their culet 4 and/or their crown such that the kites 6 of the stones 2 (likewise termed girdles) are mounted edge to edge so that the tables 8 of the stones 2 are substantially parallel or even coplanar.

Figure 10:
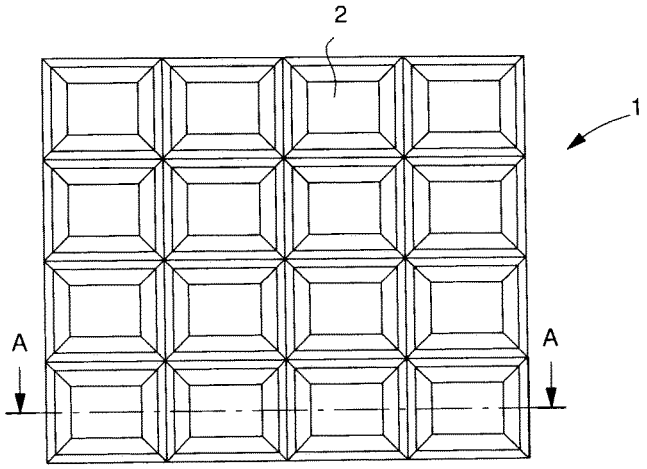
FIG. 10 is representation seen from above of a decorative piece according to the invention.
Figure 11:
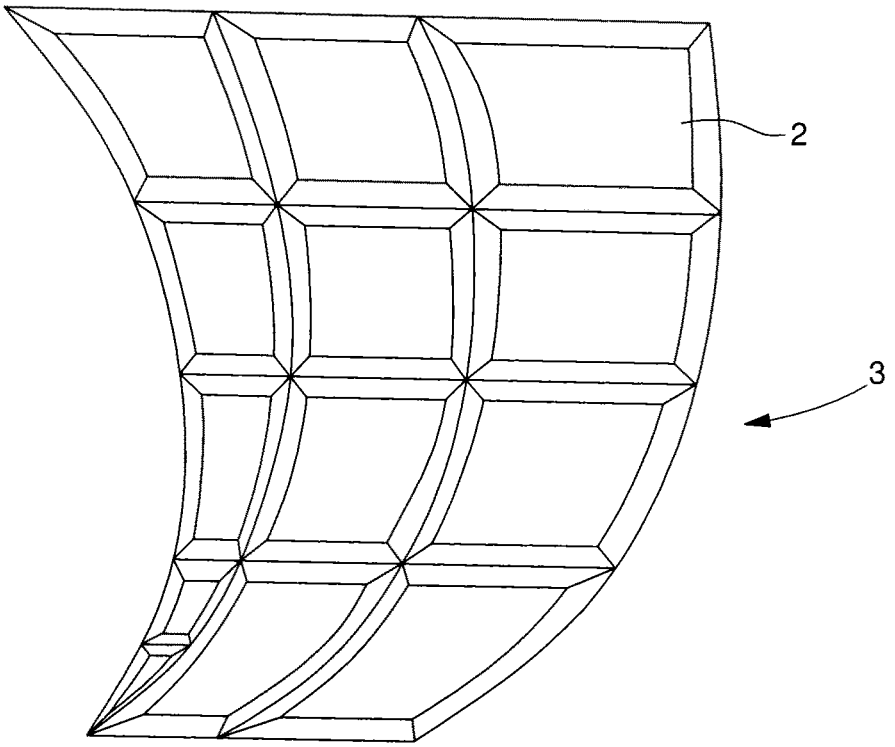
FIG. 11 is a representation seen from above of a decorative piece according to a variant of the invention.
Figure 12:
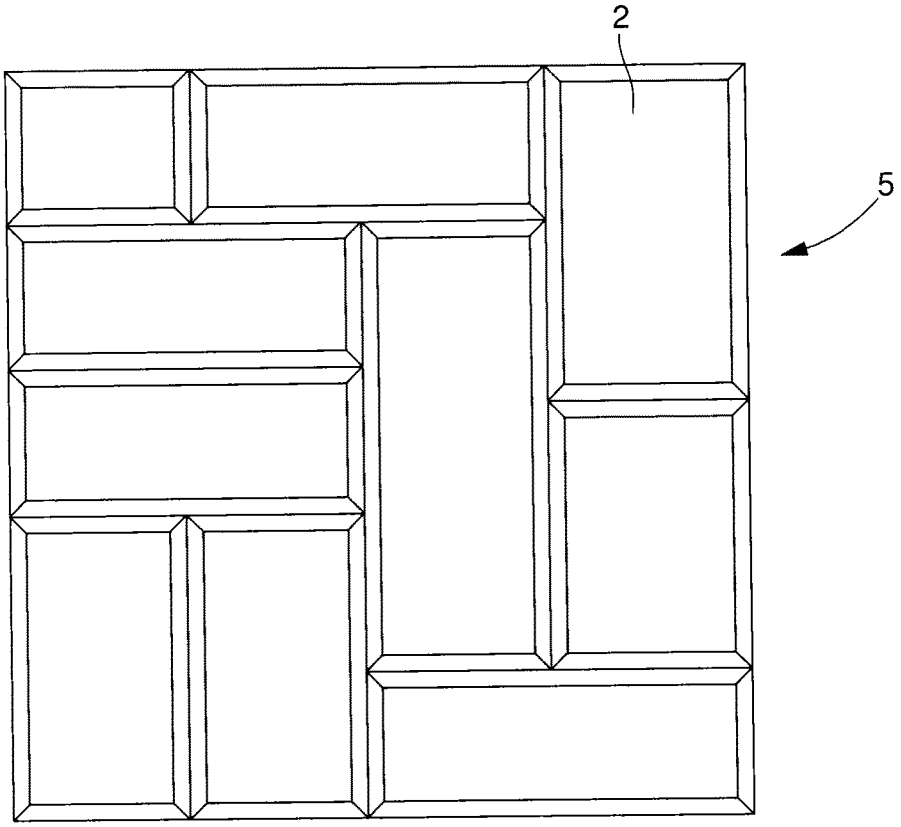
FIG. 12 is a representation seen from above of a decorative piece according to another variant of the invention.
Figure 13:
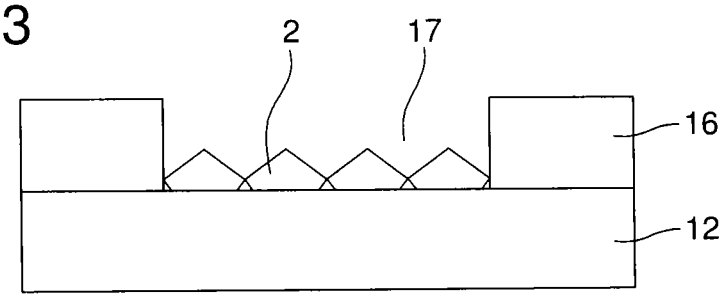
FIGS. 13 to 16 are a representation of a possibility for the method according to the invention.

Thus whatever the distribution and/or the shape of the stones 2 which are used, as illustrated for example in FIGS. 10 to 12, the fixing device 7, 7' comprises a single base 9, 9' which attaches the stones 2 relative to each other in a very precise manner. Advantageously according to the invention and contrary to what is normally implemented for manufacturing an invisible setting, the material of the base 9, 9' is applied and not removed, then deformed as required.

It is understood immediately that the single base 9, 9' makes it therefore possible to cover the culets 4 of the stones 2 perfectly with a minimum of mechanical stresses transmitted to the stones. Of course, it is conceivable that the stones 2 are attached by their crown, i.e. the single base 9, 9' makes it possible to cover the crowns of the stones 2 perfectly. Likewise, it is possible that the fixing device 7, 7' of the invisible setting type makes it possible to attach a plurality of stones 2 so that certain stones are fixed to the single base 9, 9' by their culet 4 and that certain stones are fixed to the single base 9, 9' by their crown. This alternating fixing by crown or culet can be random. In the remainder of the description, it will be described only that the fixing device 7, 7' comprises a single base 9, 9' which attaches the stones 2 relative to each other by their culet 4.

Therefore, advantageously according to the invention, the base 9, 9' is naturally of a shape corresponding to the culets 4 of the stones 2 whatever the dispersions of the latter. This is made possible by using a manufacturing method according to the invention which will be explained hereafter and which comprises in particular a material-covering step.

Figure 8:
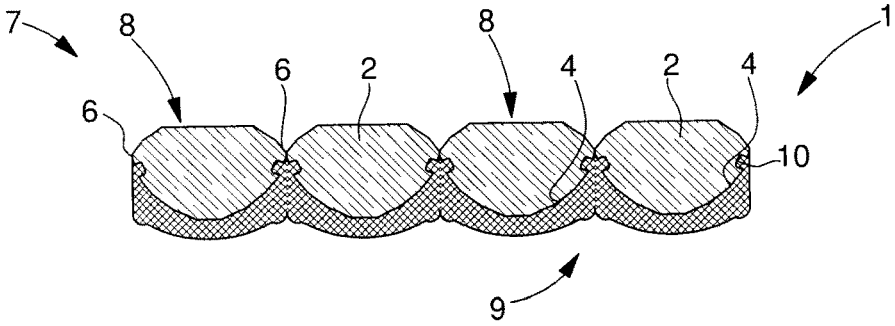
FIG. 8 is a sectional representation of a decorative piece according to the invention.

In a first embodiment illustrated in FIG. 8, the fixing device 7 comprises a single base 9 which covers the totality of the culets 4 of the stones 2. This first embodiment produces a very homogeneous aesthetic for the decorative piece 1, 3, 5.

Figure 9:
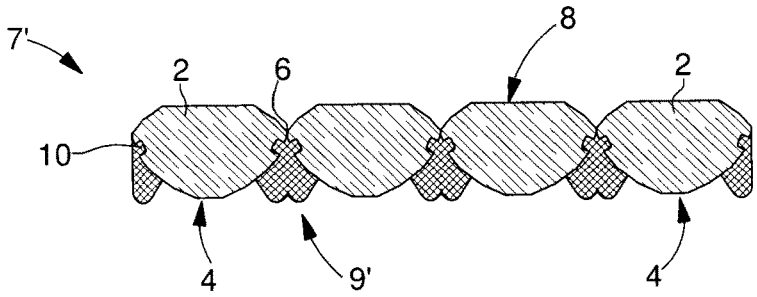
FIG. 9 is a sectional representation of a decorative piece according to another alternative of the invention.

In a second embodiment illustrated in FIG. 9, the fixing device 7' comprises a single base which does not cover the totality of the culets 4 of the stones 2. As illustrated in FIG. 9, the single base 9' thus forms a mesh which follows the kites 6 of the stones 2. This second embodiment makes it possible to improve the total internal reflection of the stones 2 which are used for the decorative piece 1, 3, 5. It also makes it possible not to need to open the single base by a mechanical route, for example with the help of a setting tool, and thus avoiding scratching the stones.

The thus formed decorative piece 1, 3, 5, even according to more or less complex shapes, such as for example an undulating shape 3 illustrated in FIG. 11, a shape 5 without particular symmetry illustrated in FIG. 12 or a shape 1 which is totally symmetrical and illustrated in FIG. 10, can consequently be set-in easily on a final product by means of its single base 9, 9'.

Figure 3:
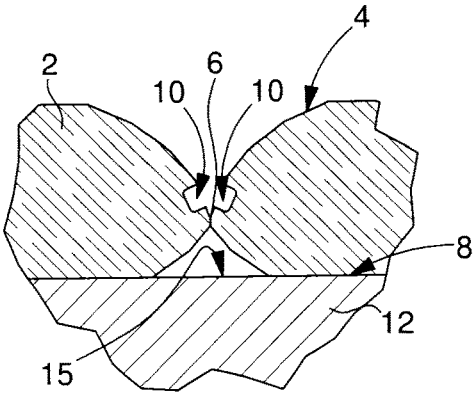
FIG. 3 is a partial enlarged representation of FIG. 2.

According to an alternative of the invention which can be seen in FIGS. 3, 8 and 9, with the aim of improving the attachment force of the fixing device 7, 7', each of the culets 4 of the stones 2 comprises at least one undercut 10. Because of the fact that the base 9, 9' corresponds perfectly to the shape of culet 4 of the stones 2, it is understood that the base 9, 9' therefore forms hooks which retain each stone 2 more firmly by its culet 4. For preference, each stone 2 comprises two undercuts 10 on two opposite facets of its culet 4. However, each undercut can likewise form a peripheral groove on each culet 4 so as to make maximum the mechanical attachment force of the fixing device 7, 7'. Of course, if the stones 2 are fixed to the single base 9, 9' by their crown, said at least one undercut 10 is situated on said crown.

According to another alternative of the invention, the single base 9, 9' can likewise directly form the body of the final product which avoids having to set-in the decorative piece 1, 3, 5 on another body.

Advantageously, the applied material, termed first material, is an amorphous or partially amorphous material. This material is preferably a metallic alloy. The term partially amorphous indicates that, for a block of material, the percentage quantity of material of said block having the amorphous state is sufficient for the block in itself to have the features specific to metals and amorphous metallic alloys. The amorphous materials have the advantage of being able to be shaped easily above their glass transition temperature Tg. They have the advantage likewise of having very little dimensional contraction during their solidification, this is because of the absence of crystallisation. Likewise it may be possible to use a precious metal or one of these alloys so as to give a precious character to said decorative piece. Hence, the precious metal or one of these alloys is included in the list comprising gold, platinum, palladium, rhenium, ruthenium, rhodium, silver, iridium or osmium.

The method of the invention will now be explained in relation to FIGS. 1 to 9 and 13. In a first step, the method consists of providing stones 2, the kites 6 of which allow assembly thereof edge to edge so as to obtain for example the embodiment variants of FIGS. 10, 11 and 12, i.e. a homogeneous plane of stones 2.

In a second step, the stones 2 are integral one after the other on a support 12. Furthermore, as can be seen better in FIG. 2, the face 15 where the stones 2 are set-in must involve good planarity. For preference, each stone 2 is integral by a first face on the face 15 of the support 12 by glueing of its table 8 by means of a glue of the epoxy type which is resistant to the temperatures used during application of the metal. Of course other types of integration which are compatible with the remainder of the steps of the method or even other types of glue are conceivable. Furthermore, it can be envisaged that the support 12 includes hollows produced in order that the table 8 of each stone 2 is inserted there. The stones 2 are therefore all placed in one hollow, which limits the freedom of movement of said stones 2.

Figure 4:
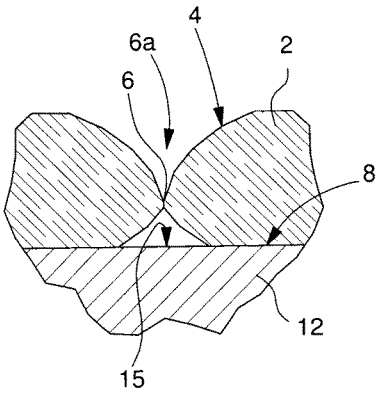
FIG. 4 is a representation of FIG. 3 according to an alternative of the invention.

FIGS. 3 and 4 represent an enlargement focused on the kites 6 of the stones 2 according to two alternatives of the invention explained above. It is therefore understood immediately that the precision in the cutting of the kites 6 or girdles of the stones 2 is of very great importance. In fact, according to the invention the kites 6 must be mounted edge to edge so as to limit the size of the interstices between the stones 2. These kites mounted edge to edge give the semblance of hollows 4.

Therefore, as explained above, in the case where it is not wished to improve the attachment force of the fixing device 7, 7', the stones 2 do not comprise undercuts 10 and are placed against each other at the level of their kites 6 as illustrated in FIGS. 1 and 4. In this case, it is understood that only the chemical interactions between the materials ensure the fixing of the stones.

Figure 5:
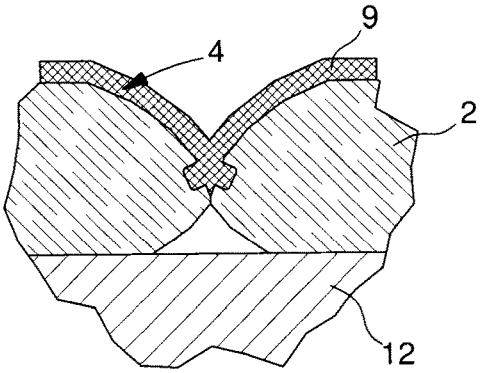
FIGS. 5 and 7 are representations similar to FIG. 3 of the material deposition according to the invention.

In the case where it is wished to improve the attachment force of the fixing device 7, 7', an intermediate step between the first joining step and the second joining step is necessary. The intermediate step is intended to engrave at least one undercut 10 in at least one part of the culets 4 of the stones 2. Therefore, during the second step or joining step, the stones 2 are brought one against the other at the level of their kites 6 as illustrated in FIGS. 1 and 5. In the embodiment of FIG. 5, it can be seen that the undercuts 10 of two stones 2 are made one opposite the other.

Figure 6:
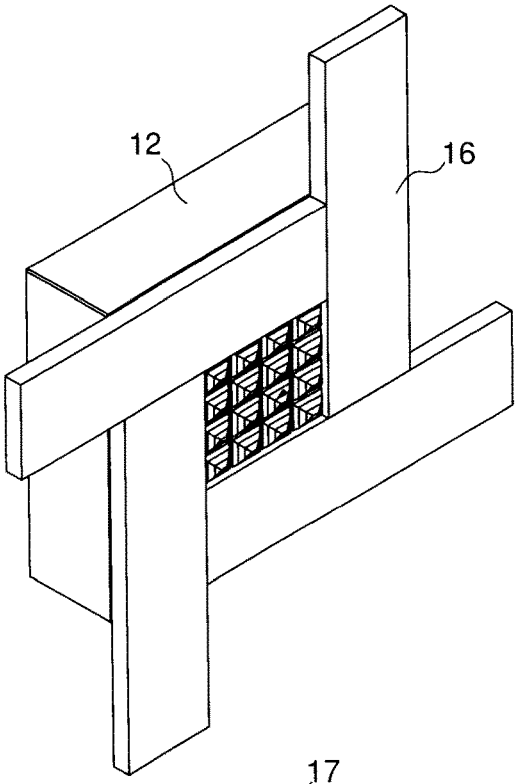
FIG. 6 is a perspective representation of a second deposition step according to the invention.
Figure 7:
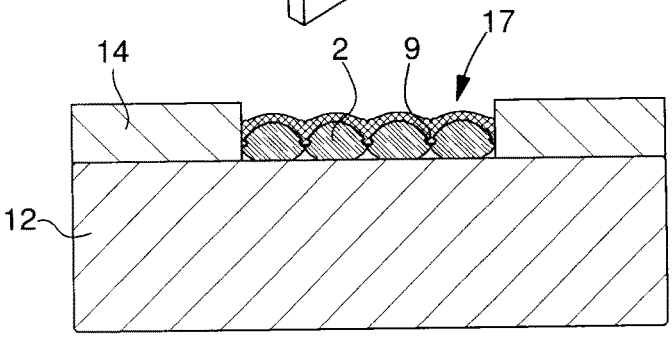

In the example illustrated in FIG. 1, it can be seen that the support 12 can likewise comprise a template 14 of a dedicated shape for assisting the starting of the plane of the stones 2. This template 14 can therefore form a set square as in FIG. 1 in order to form a symmetrical decorative piece 1 or a curved body in order to shape a decorative piece 3 in a wave. At the end of the second step, as illustrated in FIG. 1, a paved setting of stones 2 which are made integral by their table 8 on the face 15 of the support 12 is therefore obtained. It is of course conceivable that the support 12 and the template 14 only form one and the same piece. However, for preference, the template is composed of a plurality of elements which form a frame 16 designed to surround the amorphous alloy above said culets of the stones 2, as can be seen in FIGS. 6 and 7.

The method 21 continues with a step intended to form the single base 9, 9' on a second face of the stones 2.

One of the methods for depositing the material forming the base 9, 9' consists of using hot forming.

FIGS. 13 to 16 represent, in a simplified manner, the steps which make it possible to produce this single base 9, 9'.

Figure 14:
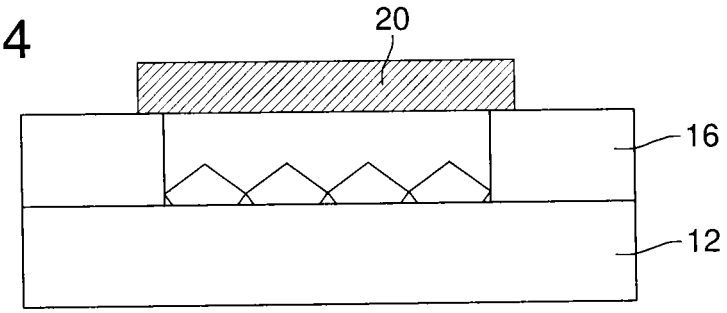

Firstly, it is necessary to produce a preform made of amorphous metallic alloy. This preform 6*a* can be produced by various techniques, such as for example injection into a casting mould, hot forming above the Tg, stamping from a strip or even by machining. Once this preform is produced, it is placed above the stones 2 and can abut on the template 14 or the frame 16, as can be seen in FIG. 14.

Figure 15:
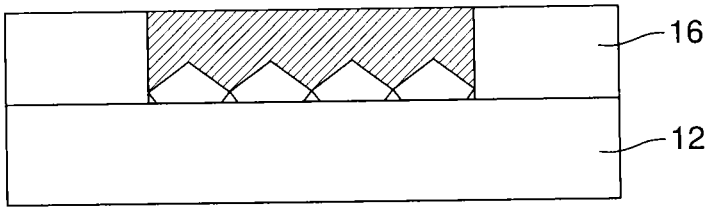
Figure 16:
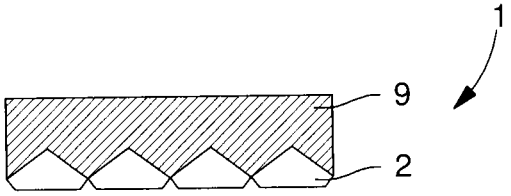
Figure 17:
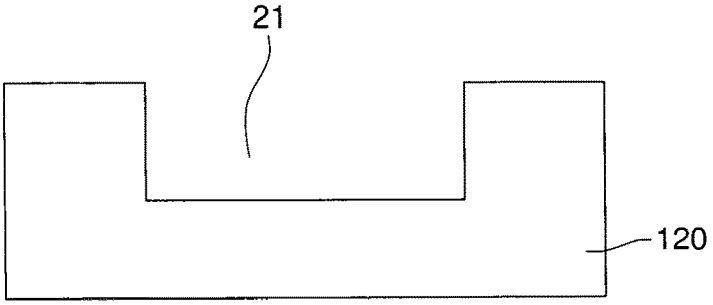
FIGS. 17 to 20 are a representation of a possibility for the method according to another embodiment of the invention.

The assembly is then heated to a temperature higher than the glass transition temperature Tg, thus allowing a reduction in the viscosity of the preform, then a pressure is exerted. Once these conditions are achieved, the pressure exerted on the viscous preform allows the viscous amorphous alloy to cover the entire surface of the stones 2 and therefore to fill the hollows 6*a* formed by the kites which are edge to edge, as can be seen in FIG. 15. Then, when the hollows 6*a* are filled, the assembly is cooled so as to retain the amorphous state of the alloy.

Materials of this type are very suitable for the reason that the great reduction in the viscosity thereof when they are heated above their Tg involves the reduction in the stress to be applied to ensure filling of the hollows 6*a* with the amorphous metallic alloy. For this reason, the stones do not face the risk of breaking even when a pressing operation is effected. On the other hand, this reduction in viscosity allows the amorphous metallic alloy to be inserted in each relief of this assembly of stones 2 and therefore to adopt all the contours thereof. Another advantage of this embodiment is that it can be produced at relatively low temperatures, which makes it possible to avoid degradation of the stones and also to reduce the risks of rupture of the stones due to thermal shocks. To this end, amorphous metallic alloys having glass transition temperatures Tg between 100 and 450° C. will be used for preference.

Of course, other types of shaping are possible, such as shaping by casting or injection. This method consists of heating a metallic preform above its melting point and casting or injecting the liquid thus obtained over the stones 2. In this present case, it can be imagined that the frame 16 has a height which is at least equal to that of the stones 2. It therefore forms a space 17 which will be filled with molten alloy. Once the space 17 is filled, a cooling step to a temperature lower than the Tg is effected so as to avoid crystallisation of the alloy in order finally to obtain a hollow 6*a* which is filled with amorphous or partially amorphous metallic alloy. In contrast to crystalline metals, amorphous metallic alloys allow this embodiment for two main reasons. Firstly, because they only have a very small amount of solidification contraction, compared with crystalline metals, respectively approx. 0.5% and 4-7%. This makes it possible to ensure very good cohesion between the stones and the amorphous metal, therefore very good retention. Secondly because the melting temperatures of amorphous metals are, for a given family of alloys, much less than those of crystalline metals. For example, the crystalline alloys of platinum have a melting point of the order of 1,600-1,700° C. whilst amorphous alloys of platinum of composition PtCuNiP have a melting point of approx. 600° C. This therefore makes it possible to simplify considerably the tooling equipment which is used and especially to maintain the integrity of the stones and in particular of diamonds which decompose towards 600-800° C. in air.

Of course shaping by powder sintering is conceivable. The method of powder sintering consists of introducing a metallic powder, having the capacity to become amorphous at cooling rates less than or equal to 100.000° C./sec, in the space 17 formed by the support 2 and the frame 16 and to solidify it by applying energy, such as a furnace, a laser beam, an ion beam or any other thermal means.

Of course, the quantity of first material, i.e. the amorphous metallic alloy, can be calculated in order to form only one layer, the thickness of which is less than that of the stones 2, or even less than half of the height of the stones 2, as can be seen in FIG. 7. This layer can mould to the shape of the stones 2.

In the alternative illustrated in FIG. 9 in which the single base 9' thus forms a mesh which follows the kite 6 of the stones 2, a stencil element is used. This stencil element has the shape of a plate comprising orifices which assume the shape of the mesh which follows the kite 6 of the stones 2. This stencil is placed in advance on the stones 2 before the step of hot forming, casting or sintering takes place. This stencil is preferably produced so as to be able to dissolve chemically. Alternatively, in the case of hot forming, the preform is produced so as to have the shape of the mesh which follows the kite 6 of the stones 2. It suffices therefore to place this preform on the stones at the level of the kite 6 of the stones 2 and to perform the hot forming operation. It might even be conceivable that the casting operation takes place by machine which will pour the molten metal directly at the level of the mesh which follows the kite 6 of the stones.

According to another alternative of the invention, the single base 9, 9' can likewise directly form the body of the final product which avoids having to set-in the decorative piece 1, 3, 5 on another body.

Subsequently, a separation step is produced. This separation step consists of separating the assembly formed by the stones 2 and the single base 9, 9' from the support 12 and from the template 14 in order to obtain the decorative piece of FIG. 16. For this, several solutions can be provided.

A first solution consists of simply dismantling the support and the template from the assembly formed by the stones 2 and the single base 9, 9'. In the case where the stones 2 are glued to the table 15 of the support 12, a chemical agent can be used to dissolve the glue.

A second solution consists of dissolving said template and the support 12. In fact, the template 14 and the support 12 are produced in a material which is able to dissolve.

Another embodiment which can be seen in FIGS. 17 to 20 can be used. This embodiment consists of taking advantage of the great elastic deformation of amorphous alloys, typically 2%, in contrast to crystalline alloys which deform plastically from 0.5%

For this, a first step consists of providing a support 120 which has a housing 121.

Figure 18:
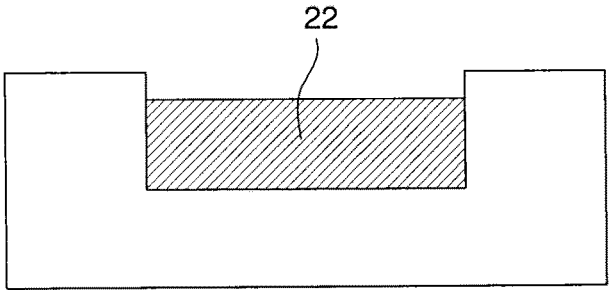

In the housing 121 of the support 120, a deposit 22 of first material which is an amorphous or partially amorphous metallic material is deposited as can be seen in FIG. 18. This deposit 22 of amorphous metallic material can be produced by the methods of hot forming or casting or injection or powder sintering described above.

Figure 19:
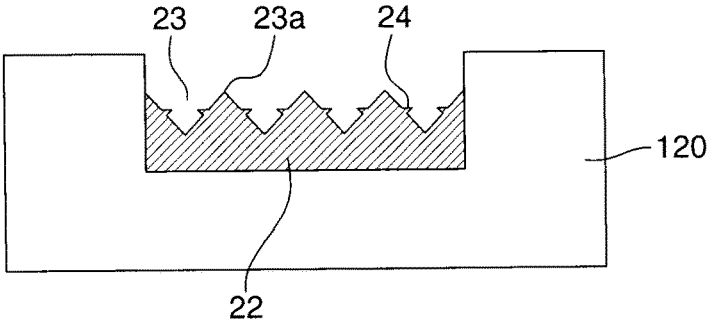

Then, the following step consists of machining this deposit 22 in order to produce holes 23 in which the stones 2 will come to be set as can be seen in FIG. 19. This Figure describes a version with stones set-in by their culets but it could very well be conceivable to have stones set-in by their crown or even an arbitrary device with stones set-in by their crown and their culet. This machining can be produced in several ways. On the one hand, it can be achieved by removing material by laser or by drilling.

This machining can likewise be achieved by using the properties of amorphous metal. In fact the latter has its viscosity reduced when it is heated to a temperature situated between its glass transition temperature Tg and its crystallisation temperature Tx. A tool having the negative geometry of the hole is applied, with a certain force, on the amorphous metal filling the hollow. It is thus possible to avoid the machining steps which can be difficult according to the amorphous alloys which are used.

Advantageously according to this embodiment, a fixing mean 24 is provided at the level of the flank 23*a* of each hole 23. This fixing mean 24 consists of at least one protuberance integral with the deposit 22.

Figure 20:
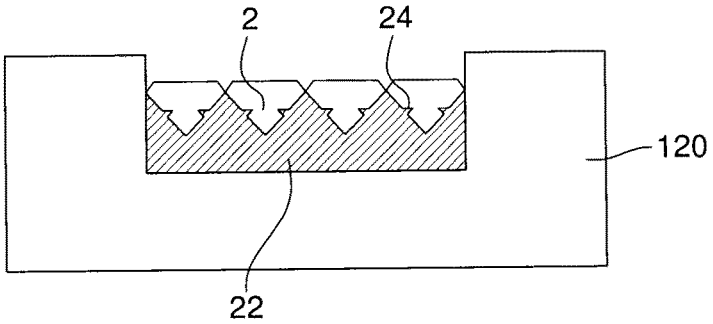
Figure 21:
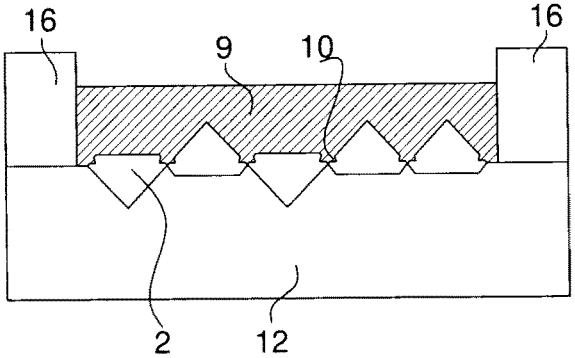
FIG. 21 is a representation seen from above of a decorative piece in which the stones are placed randomly.
Figure 22:
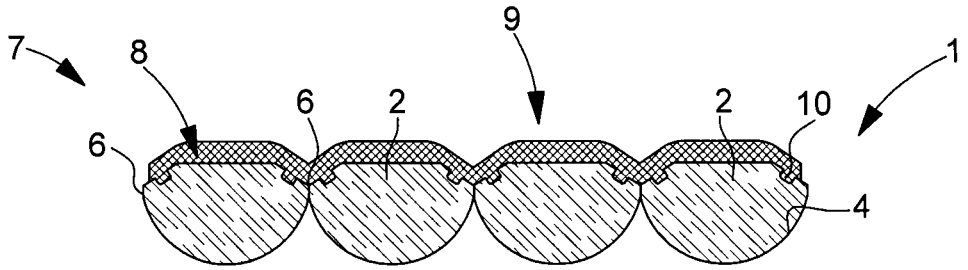
FIG. 22 is a sectional representation of a decorative piece according to another alternative of the invention.
Figure 23:
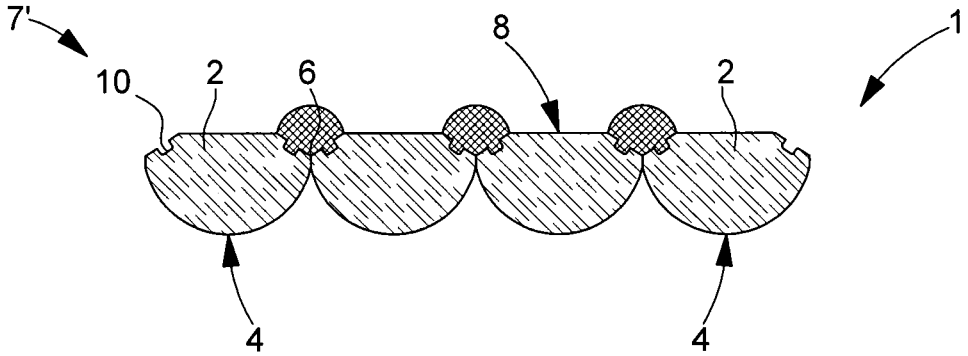
FIG. 23 is a sectional representation of a decorative piece according to another alternative of the invention.
Figure 24:
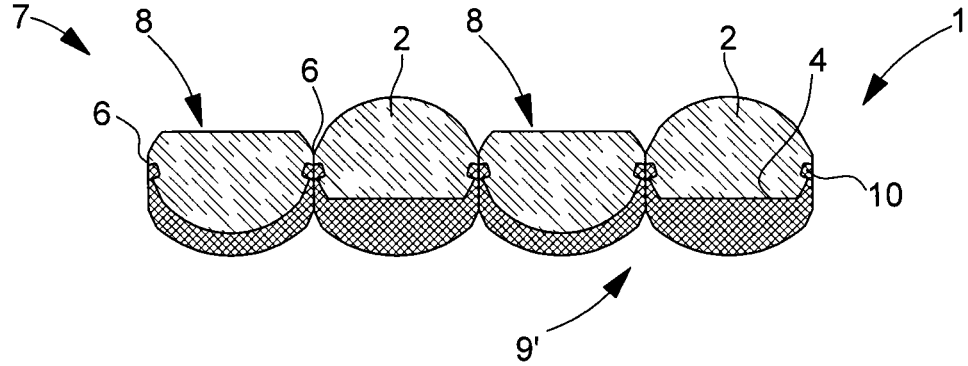
FIG. 24 is a sectional representation of a decorative piece according to another alternative of the invention.
Figure 25:
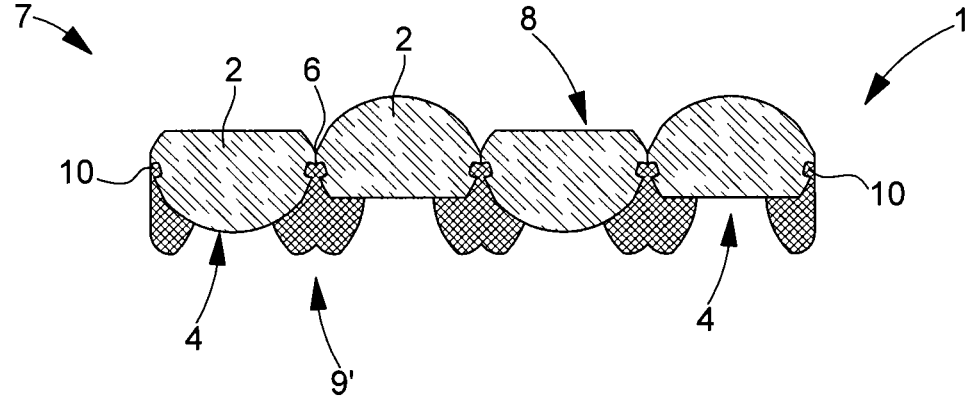
FIG. 25 is a sectional representation of a decorative piece according to another alternative of the invention.

The setting method consists therefore of pressing the stone 2 into the hole. By elastic deformation, the fixing means are deformed allowing insertion of said stone. When the protuberance is situated opposite the undercut 10 of the stone 2, an elastic resilience is exerted so that the protuberance is inserted in the undercut 10 and makes it possible to retain the latter definitively, as can be seen in FIG. 20.

For preference, the dimensions of the housing 121 are calculated so that the height of the housing is at least equal to that of the stones 2 and so that the width and/or the length are at least equal to those of the assembly of stones 2 which are set edge to edge.

FIGS. 22 to 25 show decorative pieces according to other non-limiting illustrative embodiments of the invention.

It will be understood that various modifications and/or improvements and/or combinations which are evident to the person skilled in the art can be applied to various embodiments of the invention, explained above without departing from the scope of the invention defined by the annexed claims.

What is claimed is:

1. A decorative piece comprising:

a plurality of stones, each including faces and a kite, and a single base made of a first material, the single base is fixed to all the stones and attaches the stones relative to each other by one of their faces, and kites of the stones are mounted edge to edge relative to each other so that said single base is masked, wherein the first material is an at least partially amorphous alloy.

2. The decorative piece according to claim 1, wherein the faces of each of the stones include a culet, and the single base attaches all the stones relative to each other by their culet.

3. The decorative piece according to claim 1, wherein the faces of each of the stones include a crown, and the single base attaches all the stones relative to each other by their crown.

4. The decorative piece according to claim 1, wherein the faces of each of the stones include a culet and a crown, and the single base attaches the stones so that certain stones are fixed by their culet and certain stones are fixed by their crown.

5. The decorative piece according to claim 2, wherein the single base covers a totality of the culets of said stones.

6. The decorative piece according to claim 2, wherein the single base leaves a part of the culets of said stones uncovered.

7. The decorative piece according to claim 3, wherein the single base covers a totality of the crowns of said stones.

8. The decorative piece according to claim 3, wherein the single base leaves a part of the crowns of said stones uncovered.

9. The decorative piece according to claim 2, further comprising at least one undercut produced in at least one of the stones at their culet so that the single base, of a shape corresponding at least partially to each culet, forms at least one hook for each of said at least one of the stones.

10. The decorative piece according to claim 3, further comprising at least one undercut produced in at least one of the stones at their crown so that the single base, of a shape corresponding at least partially to each crown, forms at least one hook for each of said at least one of the stones.

11. The decorative piece according to claim 9, wherein said at least one undercut forms two grooves in the culet.

12. The decorative piece according to claim 10, wherein said at least one undercut forms two grooves in the crown.

13. The decorative piece according to claim 1, wherein the first material is a totally amorphous metallic material.

14. The decorative piece according to claim 1, wherein the first material comprises at least one element which is of a precious type, included in a list comprising gold, platinum, palladium, rhenium, ruthenium, rhodium, silver, iridium or osmium.

15. The decorative piece according to claim 13, wherein the first material comprises at least one element which is of a precious type, included in a list comprising gold, platinum, palladium, rhenium, ruthenium, rhodium, silver, iridium or osmium.

16. The decorative piece according to claim 1, wherein the first material is an at least partially amorphous alloy having a glass transition temperature which is less than or equal to 450° C.

17. A timepiece, wherein it comprises, set-in, at least one of the decorative piece according to claim 1.

18. A jewelry or gemstone article, wherein it comprises, set-in, at least one of the decorative piece according to claim 1.

19. The decorative piece according to claim 1, wherein the first material is structured in only one layer, and a thickness of the layer is less than half of a height of the stones.

20. The decorative piece according to claim 1, wherein the first material is an at least partially amorphous metallic alloy that includes a solidification contraction of 0.5%.

21. The decorative piece according to claim 1, wherein the first material is an at least partially amorphous alloy having a glass transition temperature which is in a range of 100° C. to 450° C.

22. The decorative piece according to claim 1, wherein the single base is structured in only one layer, and the only one layer is made of the first material.

23. A decorative piece comprising:

a plurality of stones, each including a crown, a culet, and a girdle between the crown and the culet, and a single base made of a first material, the single base is fixed to all the stones and secures the stones relative to each other by either the crown or the culet, and the girdles of the stones abut so that said single base is masked, wherein the single base is structured in only one layer, the only one layer is made of the first material, and the first material is an at least partially amorphous alloy.

24. The decorative piece according to claim 23, wherein the single base attaches all the stones relative to each other by their culet.

25. The decorative piece according to claim 23, wherein the single base attaches all the stones relative to each other by their crown.

26. The decorative piece according to claim 23, wherein the single base attaches the stones so that certain stones are fixed by their culet and certain stones are fixed by their crown.

27. The decorative piece according to claim 24, wherein the single base covers a totality of the culets of said stones.

28. The decorative piece according to claim 24, wherein the single base leaves a part of the culets of said stones uncovered.

29. The decorative piece according to claim 25, wherein the single base covers a totality of the crowns of said stones.

30. The decorative piece according to claim 25, wherein the single base leaves a part of the crowns of said stones uncovered.

31. The decorative piece according to claim 24, further comprising at least one undercut produced in at least one of the stones at their culet so that the single base, of a shape corresponding at least partially to each culet, forms at least one hook for each of said at least one of the stones.

32. The decorative piece according to claim 25, further comprising at least one undercut produced in at least one of the stones at their crown so that the single base, of a shape corresponding at least partially to each crown, forms at least one hook for each of said at least one of the stones.

33. The decorative piece according to claim 31, wherein said at least one undercut forms two grooves in the culet.

34. The decorative piece according to claim 32, wherein said at least one undercut forms two grooves in the crown.

35. The decorative piece according to claim 23, wherein the first material is a totally amorphous metallic material.

36. The decorative piece according to claim 23, wherein the first material comprises at least one element which is of a precious type, included in a list comprising gold, platinum, palladium, rhenium, ruthenium, rhodium, silver, iridium or osmium.

37. The decorative piece according to claim 35, wherein the first material comprises at least one element which is of a precious type, included in a list comprising gold, platinum, palladium, rhenium, ruthenium, rhodium, silver, iridium or osmium.

38. The decorative piece according to claim 23, wherein the first material is an at least partially amorphous alloy having a glass transition temperature which is less than or equal to 450° C.

39. A timepiece, wherein it comprises, set-in, at least one of the decorative piece according to claim 23.

40. A jewelry or gemstone article, wherein it comprises, set-in, at least one of the decorative piece according to claim 23.

41. The decorative piece according to claim 23, wherein a thickness of the only one layer is less than half of a height of the stones.

42. The decorative piece according to claim 23, wherein the first material is an at least partially amorphous metallic alloy that includes a solidification contraction of 0.5%.

43. The decorative piece according to claim 23, wherein the first material is an at least partially amorphous alloy having a glass transition temperature which is in a range of 100° C. to 450° C.

* * * * *